US008944184B2

(12) United States Patent
Leiner et al.

(10) Patent No.: US 8,944,184 B2
(45) Date of Patent: Feb. 3, 2015

(54) SUSPENSION EXTRACTION DEVICE

(75) Inventors: Norbert Leiner, Berlin (DE); Fabian Kirsch, Berlin (DE); Kerstin Boerner, Strausberg (DE); Kerstin Deterding, Berlin (DE); Juergen Appelius, Oranienburg (DE); Josef Patron, Mahlow-Waldblick (DE); Martin Staudt, Wilhelmsdorf (DE); Nikolaus Schneider, Michendorf (DE)

(73) Assignee: GuD Geotechnik und Dynamik GmbH, Berlin (DE)

( * ) Notice: Subject to any disclaimer, the term of this patent is extended or adjusted under 35 U.S.C. 154(b) by 365 days.

(21) Appl. No.: 13/570,948

(22) Filed: Aug. 9, 2012

(65) Prior Publication Data

US 2013/0064610 A1 Mar. 14, 2013

(30) Foreign Application Priority Data

Sep. 14, 2011 (DE) ..... 10 2011 082 658

(51) Int. Cl.
*G01N 1/10* (2006.01)
*E02D 3/12* (2006.01)
*E21B 7/18* (2006.01)

(52) U.S. Cl.
CPC .... *E02D 3/12* (2013.01); *E21B 7/18* (2013.01)
USPC ..... 175/58

(58) Field of Classification Search
USPC ..... 175/58–60; 166/264; 73/864.61, 864.62
See application file for complete search history.

(56) References Cited

U.S. PATENT DOCUMENTS 6,360,620 B1 * 3/2002 Jensen ..... 73/864.62
2009/0178849 A1 7/2009 Schneider

FOREIGN PATENT DOCUMENTS

DE 19648548 C2 6/1998
DE 102006002838 B3 9/2007
DE 102011082658 A1 3/2013

OTHER PUBLICATIONS

German Search Report issued in counterpart Application No. 10 2011 082 658 dated Aug. 29, 2012.
English Translation of Office Action issued in German Application 10 2011 082 dated Jun. 28, 2013.

* cited by examiner

*Primary Examiner* — Sunil Singh
(74) *Attorney, Agent, or Firm* — Venable LLP; Robert Kinberg

(57) ABSTRACT

The present invention concerns a device for proving the quality of a jet grouting body. Such a jet grouting body is produced by means of a drilling and grouting linkage assembly. An extraction device according to the invention for extracting a suspension from such a jet grouting body comprises: a first segment with a cavity comprising a fluid, in particular a liquid, in which a first chamber is provided, the volume of which can be modified and which is connected with an opening for extracting a specimen, and a further segment which is intended to receive the fluid from the cavity. By receiving the fluid in the further segment, the volume of the first chamber can be enlarged; furthermore the extraction device can be integrated in a drilling and grouting linkage assembly.

12 Claims, 4 Drawing Sheets

SUSPENSION EXTRACTION DEVICE

TECHNICAL FIELD

The present invention concerns a device for proving the quality of a jet grouting body. Such a jet grouting body is produced by means of a drilling and grouting linkage assembly. In particular the soil at a particular depth is processed with a high pressure jet and mixed with a hardening suspension. The region of the soil in which the jet grouting body is produced (jet grouting pile) must be studied to establish the quality of the jet grouting body to be produced.

PRIOR ART

Constricted inner city spatial conditions, because of the restricted construction height of new build projects, lead to an ever more intensive use of the land in the form of basements and underground parking levels. This development trend of using the ground at depth has increased substantially in recent years.

In this context so-called trough pits are known which can avoid greater falls in ground water levels. These trough pits are closed with an underground horizontal jet grouting floor in order to meet the requirements of the building approval authorities for environmentally-friendly construction methods which protect ground water levels. This floor type is a broad supporting element stressed in two axes which supports the trough horizontally in the floor region and at the same time is secured against lifting with compression piles.

To dig a trough pit, in particular in sandy ground and with high water levels, use of the conventional methods of excavation is scarcely possible as great falls in ground water levels would occur.

The requirements for a jet grouting body to be produced arise substantially from the static or hydraulic function and for this reason can vary widely in quality. The success or failure of measures with the jet grouting pile method therefore depends primarily on the implementation of the required quality guidelines.

The causes of faults can lie both in planning and in performance. For this reason building owners require ever more precise proof of the quality of the jet grouting body produced.

In particular in the test stage with trial piles, it is necessary to record, process and depict relevant data. This allows documentation of diameters and strengths of the jet grouting piles achieved, and later identification of possible fault points. By mixing the adjacent ground with the cement suspension, a non-standardised construction material is produced. However in its completed state, the jet grouting body must fulfil sophisticated functions such as sealing and static compressive strength.

Compressive strength is an important property of concrete. Relevant DIN standards stipulate assessment by testing after 28 days with cubes of 15 cm edge length (specimen cubes) or 30 cm long cylinders with 15 cm diameter. The compressive strength determined allows the concrete to be allocated to strength classes. A C12/15 consequently has a characteristic cylinder compressive strength of 12 $N/mm^2$ and a characteristic cube compressive strength of 15 $N/mm^2$.

Previously, specimens were taken from sample piles previously produced in a complicated manner, in that corresponding specimen bodies were extracted by means of core drilling or specimen bodies were produced from the supply suspension or return suspension. This method is very time-consuming and costly, and the quality of result is questionable.

Another alternative is the extraction of suspension specimens from the return suspension during the production process on the surface. However, the suspension separates out by mixing with the adjacent ground and ground water, and the characteristic material values derived therefrom change greatly.

Furthermore, by extraction from the hardened pile in a further drilling campaign, drilling cores can be taken from a jet grouting body at depth. However great distortions occur since firstly the extracted core is damaged due to the drilling process and usually no representative characteristic values can be obtained. The drilling core is damaged by the drilling.

OBJECT OF THE INVENTION

The object of the present invention is to solve the problems described above and provide a device for assessing a jet grouting pile/body.

A corresponding device is provided by the subject of claim 1. Further preferred embodiments are given in the dependent claims.

A core concept of the present invention is to integrate an extraction device in a drilling and jet linkage assembly, in particular by means of a modular insertable segment. The extraction device should allow a specimen to be taken from a jet grouting pile during operation of the drilling and grouting linkage assembly for later analysis. Accordingly it is not necessary to remove the drilling and grouting linkage assembly from the hole in order to extract a specimen, but the specimen can be taken while the drilling and grouting linkage assembly remains in the hole. "Collapse" of the hole need not therefore be feared.

According to the present invention an extraction device that can be integrated in a drilling and grouting linkage assembly has the following features: a first segment with a cavity comprising a fluid, in particular a liquid, in which a first chamber is provided, the volume of which is modifiable and which is connected with an opening for extraction of a specimen. Furthermore the extraction device comprises a further segment intended to receive the fluid from the first cavity, wherein the volume in the first chamber can be enlarged by reception of the fluid in the further segment.

Such a device offers the advantage that it can take a specimen directly from a jet grouting pile. Because the specimen is taken directly from the jet grouting pile, the properties of the jet grouting body to be produced can be qualified precisely. The mechanism described can be implemented in a drilling and grouting linkage assembly and can furthermore be fitted to existing assemblies. Also by establishing the quantity of the fluid to be transferred, at the same time the specimen size can be defined precisely. It is also possible to remove the specimen from the first chamber relatively easily in that the fluid is transferred back from the further segment to the cavity of the first segment. For the extraction device to be integratable into the drilling end grouting linkage assembly, in a first embodiment said device can have an outer diameter or periphery which is substantially the same as the other segments of the drilling and grouting linkage assembly.

In a preferred embodiment the device is fitted with a pump and/or valve with which the fluid can be transferred from the cavity to the further segment. Thus the specimen size can be defined precisely and the time of specimen extraction defined precisely.

In a further embodiment a second chamber is provided in the further segment contained in a cavity of the further segment, the volume of which can be modified. Thus the second chamber constitutes a component complementary to the first chamber and, with the same cavity dimensions of the first and further segments, by complete transfer of the fluid to the second chamber it can be ensured that the first chamber is completely evacuated.

In a particularly preferred embodiment the first chamber is made of an elastic material (e.g. a rubber bladder). It can also be provided that the second chamber comprises an elastic material (e.g. a rubber bladder). This has the advantage in each case that the respective chamber can adapt to the circumstances of the respective cavity of the first and further segment of the extraction device when the respective volume of the first or second chamber reaches a maximum value.

According to the present invention it is proposed in particular that the extraction device can be integrated in a drilling and grouting linkage assembly, in particular by means of a screw connection. This makes the extraction device easy to fit to existing assemblies and thus it can also be used on drilling and grouting linkage assemblies already in use. The screw connection is for example provided such that the extraction device can be screwed into other segments of the drilling and grouting linkage assembly.

As well as the extraction device itself, the present invention concerns a drilling and grouting linkage assembly with such an extraction device. Here it is proposed that the extraction device is integrated in the drilling and grouting linkage assembly between a nozzle apparatus for generating a grouting jet and a drill bit. In this way it is possible to extract a representative specimen of the jet grouting pile.

In a particular embodiment the extraction device can be controlled by means of body-borne sound pulses or a power supply via the drilling and grouting linkage assembly. This allows a particularly simple combination with the extraction device so that this can be initialised for extraction of a specimen from a jet grouting pile.

Furthermore the present invention concerns a method for extracting a specimen from a jet grouting pile, wherein first a jet grouting pile is produced by introduction of a suspension. Then a fluid which surrounds a first chamber in a first segment of an extraction device is received in a further segment of the extraction device. This enlarges the volume of the first chamber and a specimen can be drawn into the first chamber.

As a jet grouting body only comprises partly standardised materials, namely the suspension introduced into the jet grouting pile, by extracting the specimen directly from the jet grouting pile the precise composition can be determined i.e. firstly the suspension and secondly the additives from the soil which is mixed with the suspension.

DETAILED DESCRIPTION OF PREFERRED EMBODIMENTS

Purely as examples, preferred embodiments of the present invention are described below with reference to the enclosed drawings. It should be noted that individual features of the individual embodiments can also be used in combination with features of other embodiments.

Figure 1:
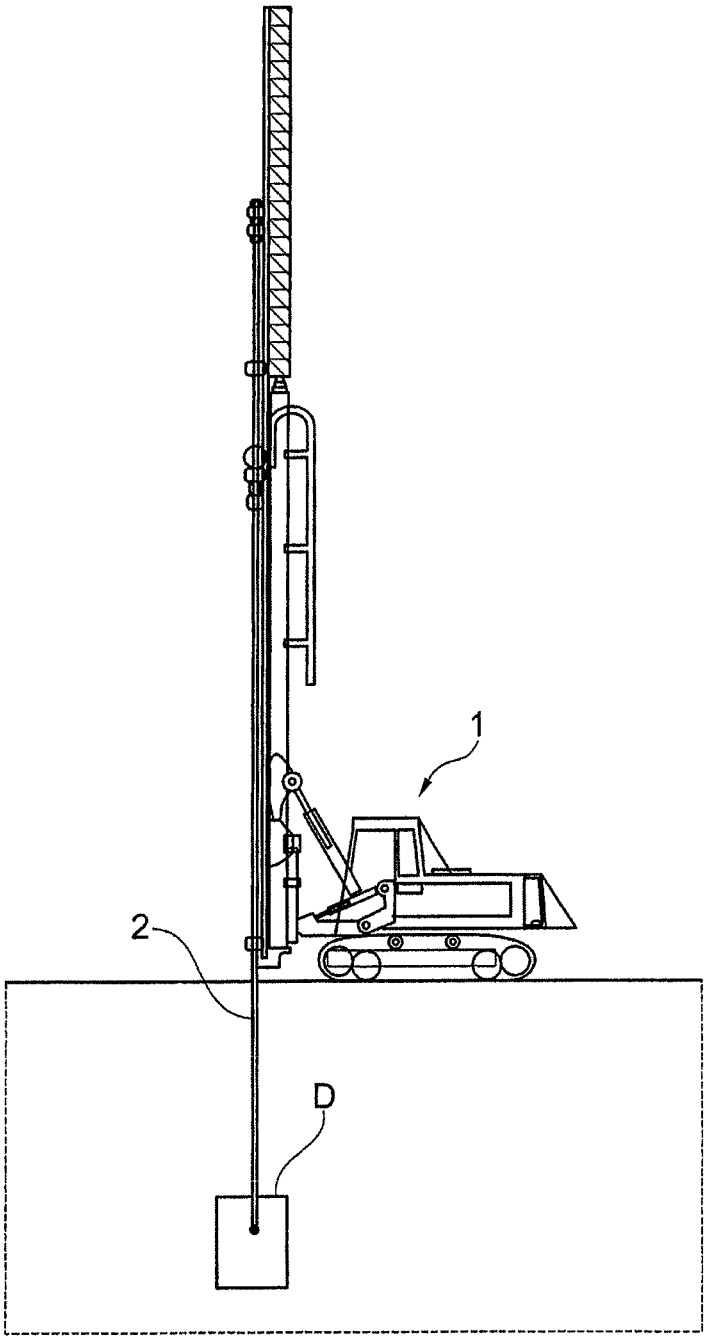
FIG. 1 shows diagrammatically the introduction of a jet grouting pile in a subsoil.

FIG. 1 shows diagrammatically a mobile machine 1 on which a drilling and grouting linkage assembly 2 is mounted. Here at a particular depth, using the drilling and grouting linkage assembly 2, a jet grouting pile D is introduced into the soil, in that an energy-rich high pressure jet changes the original stratification of the soil and fills this with a suspension at the same time or with a time delay. This produces a so-called jet grouting body which has a higher strength than the surrounding soil and which can be used as a sealing element, a supporting element or a combination thereof.

Figure 2:
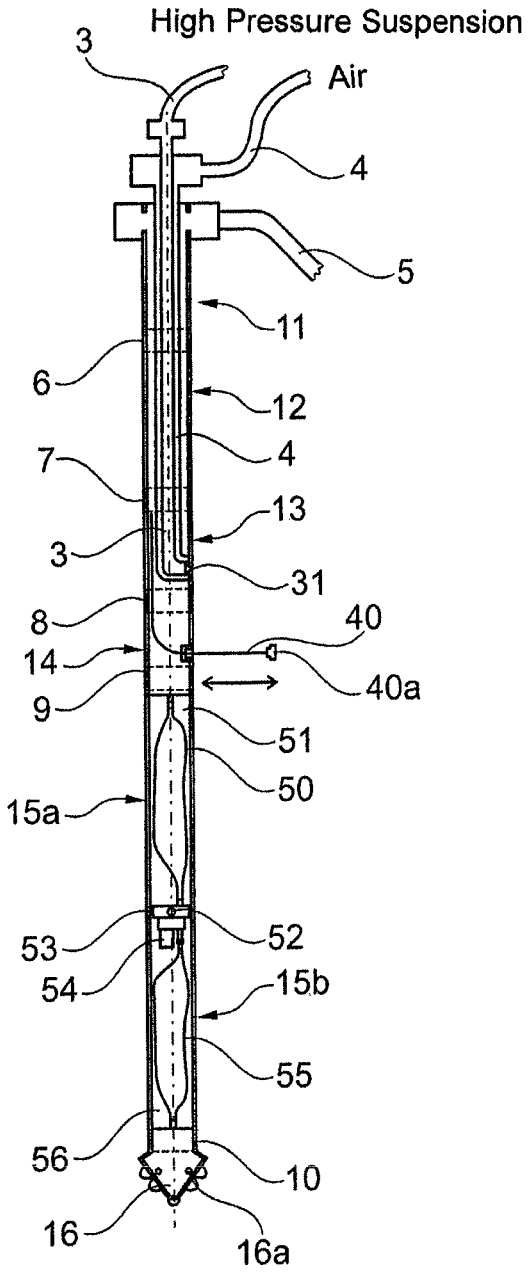
FIG. 2 shows a detailed view of a drilling and grouting linkage assembly comprising the extraction device according to the invention.

FIG. 2 shows a functional view of the drilling and grouting linkage assembly 2. This is composed of various segments, namely a connecting segment 11, an intermediate segment 12, a nozzle device 13, a measurement device 14, an extraction device 15 and a drill bit 16. These elements are arranged in the corresponding order and connected by means of threaded joints.

A high pressure suspension line 3 for the high pressure suspension, a line 4 for air and a line 5 for the drilling flusher are routed to the drilling and grouting linkage assembly 2.

The nozzle device 13 is designed for application at high pressure of a high pressure suspension supplied through a high pressure suspension line 3. As a working fluid for supporting the high pressure suspension, preferably air is provided which is supplied through a further line 4.

In the present embodiment example, screw-fit thread connections 6 to 10 are provided. Sealing rings ensure that no contaminants enter the measurement device 14 for example in operation. As an alternative to the screw connections 6 to 10, individual radially acting bolts can also be provided. Other plug connections are also conceivable.

Guided in the measurement device 14 is a rod or cable-like scanning element 40 with a sensor 40*a*. After the scanning element 40 within the measurement device 14 has been brought from a vertical direction (path inside the nozzle device 13) into a substantially horizontal direction, the scanning element 40 extends through the retraction and extension housing 43. The retraction and extension housing 43 has a sealing element which seals the inside of the measurement device 14 against the outside.

Details of said measurement device are given in unpublished European Patent Application EP 11 172 830.9 to which reference is made in this context.

Figure 3:
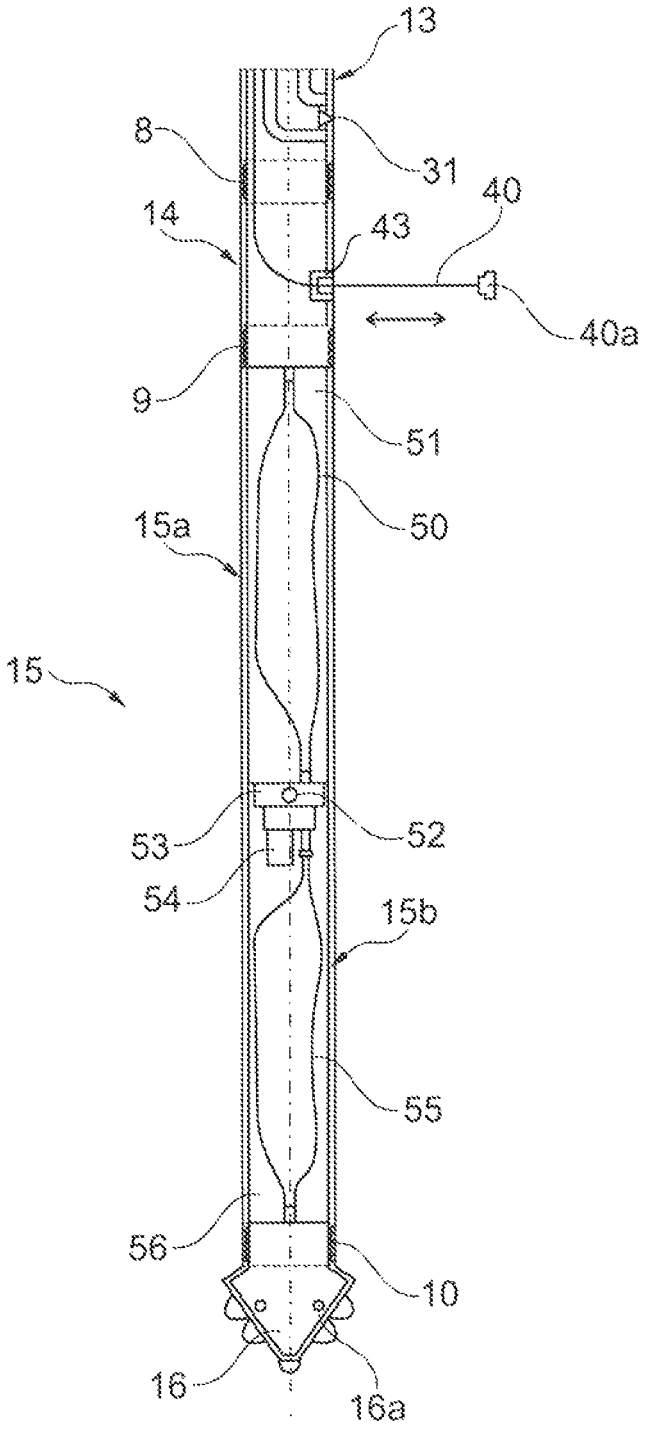
FIG. 3 is a detailed view of the drilling and grouting linkage assembly in FIG. 2.

Furthermore, the present drilling and grouting linkage assembly 2 however comprises the extraction device 15 which is integrated in the drilling and grouting linkage assembly 2 (see in particular FIG. 3). The extraction device 15 has an upper segment 15*a* and a lower segment 15*b*, wherein the term "lower" is to be interpreted as in the direction pointing towards the drill bit 16, while the term "upper" is to be interpreted as in the direction pointing towards the connecting segment 11.

In the upper segment 15*a* of the extraction device 15 is held a rubber bladder 50 which is surrounded inside the upper segment 15*a* by a fluid-filled cavity 51. An opening in the rubber bladder 50 is connected to a specimen-taker 53. The specimen-taker 53 has a suction opening 52 which opens into the environment of the drilling and grouting linkage assembly 2. As described later, through this suction opening 52 a specimen can be introduced into the specimen-taker 53.

In the region of the lower segment 15*b* of the extraction device 15 is provided a pump/valve unit 54. A lower rubber bladder 55 is connected to this which extends within the lower segment 15*b* and is surrounded by a cavity 56.

The function of the extraction device 15 according to the invention can be explained as follows.

On specimen extraction, the fluid in the cavity 51 of the upper segment 15*a* surrounding the upper rubber bladder 50 is pumped by a pump and/or valve 54 into the lower rubber bladder 55. This allows the upper rubber bladder 50 to expand. Because the upper rubber bladder 50 is connected via specimen-taker 53 with the suction opening 52, through this a specimen of the suspension in the jet grouting pile D is drawn in. If a large part of the fluid from the cavity 51 has been pumped into the lower rubber bladder 55, the upper rubber bladder 50 is thus filled with a corresponding specimen. The size of the specimen can thus be controlled via the fluid from the cavity 51 pumped to the lower rubber bladder 55.

The drilling and grouting linkage assembly 2 with the extraction device 15 is then raised to the surface. To extract the specimen now from the upper rubber bladder 50, the fluid is pumped from the lower rubber bladder 55 back to the cavity 51 of the upper section 15*a*. In this way the specimen in the upper rubber bladder 50 is expelled from this as the upper rubber bladder 50 is compressed by means of the fluid. When all the fluid has been transferred from the lower rubber bladder 55 to the cavity 51, the specimen is completely expelled from the upper rubber bladder 50.

It is now possible to connect a flushing device to the suction opening 52 so the upper rubber bladder 50 is flushed in order to remove all suspension residue from the bladder. A flushing process can for example last for one minute.

The specimen removed from the extraction device 15 is analysed in a further step. Important features to be monitored for the fatigue strength of the concrete of the jet grouting body are the concrete composition (water/cement value, cement content), the strength class, compaction and post-treatment of the concrete.

For this test bodies can be produced from the material taken from the jet grouting pile which correspond to the composition of the jet grouting body to be formed because they are taken directly from the jet grouting pile. Such specimen bodies can for example be produced in so-called cube chambers which can then harden under standardised conditions.

Figure 4:
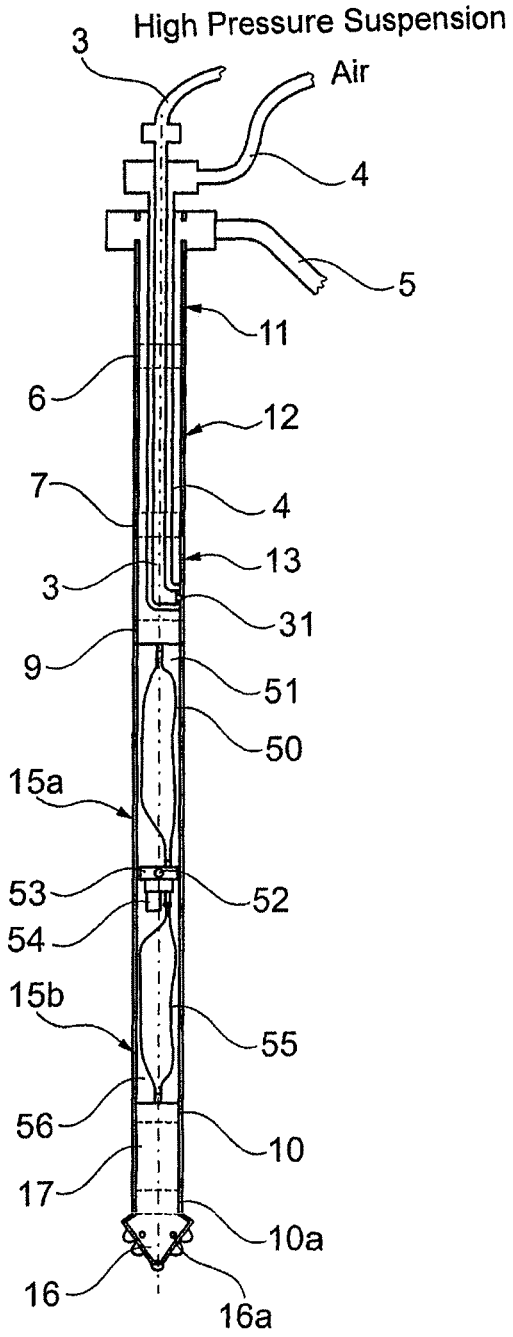
FIG. 4 shows a further embodiment of the drilling and grouting linkage assembly with an extraction device according to the invention.

FIG. 4 shows a further embodiment of a drilling and grouting linkage assembly 2. This differs from the embodiment described before in that the measuring device 14 is not provided in this drilling and grouting linkage assembly. Here the modular structure is shown and it is evident that the segments 11 to 16 previously described can be combined with each other arbitrarily.

Furthermore, it can be provided to attach further segments to the drilling and grouting linkage assembly 2. In this embodiment a further adaptor 17 is shown which is connected via a screw connection 10*a* with the drill bit 16 and via screw connection 10 with the extraction device 15.

Furthermore, in this embodiment it is provided that the rubber bladders 50, 55 are connected to the specimen-taker 53 and attached at opposite ends of the upper/lower segment 15*a*, 15*b*. In other words in this embodiment the respective rubber bladders 50, 55 are not mounted on the side walls of segments 15*a*, 15*b*.

As well as the design of the extraction device 15 with an upper rubber bladder 50 and a lower rubber bladder 55, pistons can also be provided in the cavities 51, 56 which define a chamber and a cavity in the upper segment 15*a* and also a chamber and a cavity in the lower segment 15*b*. These chambers then correspond to the upper rubber bladder 50 and the lower rubber bladder 55.

However in a further embodiment it can be provided that instead of the rubber bladder in the upper and lower segment 15*a*, 15*b*, an elastic membrane is mounted in a region of a respective side wall. If a fluid is guided from a cavity in the upper segment 15*a* into a cavity of the lower segment 15*b*, the chamber defined by the elastic membrane in this embodiment in the upper segment 15*a* is enlarged.

The invention claimed is:

1. An extraction device for a drilling and grouting linkage assembly used for production of a jet grouting pile; the extraction device comprising:

a first segment having a cavity and a first chamber position in the cavity, wherein the first segment is adapted to hold a fluid in the cavity outside the first chamber, wherein the first chamber has a volume that is modifiable and wherein the first chamber is connected with an opening for extraction of a specimen, and a further segment coupled to receive the fluid from the cavity;

wherein by receiving the fluid in the further segment, the volume of the first chamber is enlarged; and wherein the extraction device is adapted to be integrated in the drilling and grouting linkage assembly.

2. The device according to claim 1, further including a pump and/or valve unit arranged to transfer the fluid from the cavity to the further segment.

3. The device according to claim 1, wherein the further segment includes a further cavity and a second chamber arranged in the further cavity of the further segment wherein the second chamber has a volume that is modifiable.

4. The device according to claim 1, wherein the first chamber comprises an elastic material.

5. The device according to claim 3, wherein the second chamber comprises an elastic material.

6. The device according to claim 1, further including screw connections to integrate the extraction device with other segments of the drilling and grouting linkage assembly.

7. The device according to claim 1, further comprising a specimen taker arranged between the first segment and the further segment and which included the opening; wherein the first chamber is coupled to a the specimen-taker.

8. The device according to claim 1, further comprising a piston mechanism to modify the volume of the first chamber.

9. The device according to claim 1, wherein the first chamber is defined by an elastic membrane attached to side walls of the cavity.

10. The extraction device according to claim 1 forming a combination with the drilling and grouting linkage assembly, wherein the drilling and grouting linkage assembly includes a nozzle device to generate a grouting jet and a drill bit, and the extraction device is integrated in the drilling and grouting linkage assembly between the nozzle and the drill bit.

11. The combination according to claim 10, wherein the extraction device is controlled by body-borne sound pulses or a power supply via the drilling and grouting linkage assembly.

12. A method for taking a specimen from a jet grouting pile, comprising:

producing a jet grouting pile with introduction of a suspension; and receiving a fluid surrounding a first chamber of a first segment of an extraction device in a further segment to thereby enlarge a volume of the first chamber to draw a specimen into the first chamber.

* * * * *